US009033031B1

(12) United States Patent
Carr et al.

(10) Patent No.: US 9,033,031 B1
(45) Date of Patent: May 19, 2015

(54) WELL CONTROL AND RETRIEVAL TOOL

(71) Applicant: SOAR Tools, LLC, Snyder, TX (US)

(72) Inventors: Dee A. Carr, Snyder, TX (US); Jerry Pechacek, Snyder, TX (US)

(73) Assignee: SOAR Tools, LLC, Snyder, TX (US)

( * ) Notice: Subject to any disclaimer, the term of this patent is extended or adjusted under 35 U.S.C. 154(b) by 211 days.

(21) Appl. No.: 13/623,762

(22) Filed: Sep. 20, 2012

Related U.S. Application Data

(60) Provisional application No. 61/549,666, filed on Oct. 20, 2011.

(51) Int. Cl.
*E21B 23/00* (2006.01)
*E21B 23/03* (2006.01)

(52) U.S. Cl.
CPC ..... *E21B 23/03* (2013.01)

(58) Field of Classification Search
USPC ..... 166/162, 169, 242.6, 242.7
See application file for complete search history.

(56) References Cited

U.S. PATENT DOCUMENTS

| | | | | |
|---|---|---|---|---|
| 3,556,212 | A | 1/1971 | Vazquez et al. | |
| 4,043,390 | A | 8/1977 | Glotin | |
| 4,171,934 | A | 10/1979 | Zehren | |
| 4,440,221 | A | 4/1984 | Taylor et al. | |
| 4,477,104 | A * | 10/1984 | Akkerman | 285/18 |
| 4,749,341 | A | 6/1988 | Bayh, III | |
| 4,756,364 | A | 7/1988 | Christensen et al. | |
| 4,765,403 | A | 8/1988 | Crawford et al. | |
| 4,823,872 | A * | 4/1989 | Hopmann | 166/217 |
| 4,883,120 | A | 11/1989 | Schasteen et al. | |
| 4,913,239 | A | 4/1990 | Bayh, III | |
| 5,374,163 | A | 12/1994 | Jaikaran | |
| 5,503,224 | A | 4/1996 | Field | |
| 6,926,504 | B2 | 8/2005 | Howard | |
| 7,748,449 | B2 | 7/2010 | Bussear et al. | |
| 8,517,114 | B2 * | 8/2013 | Nevels et al. | 166/377 |
| 2004/0137778 | A1 * | 7/2004 | Mattheeuws et al. | 439/352 |
| 2011/0042107 | A1 | 2/2011 | Chambers et al. | |

OTHER PUBLICATIONS

Baker Hughes, Flow Control Systems catalog, 2010.

* cited by examiner

*Primary Examiner* — William P Neuder
(74) *Attorney, Agent, or Firm* — John G. Fischer, Esq.; Scheef & Stone, L.L.P.

(57) ABSTRACT

A downhole well control tool allows for the control of in-situ fluid flow from a production well. The flow control tool is engaged to an electrical submersible pump ("ESP") and allows for the in-situ fluid to flow through the tool when the ESP is both active and inactive. The tool also allows for the flow of drilling mud and other drilling fluids when necessary. In addition, the well control tool may also be used to seal off the flow of fluids, and may be used in the retrieval of the ESP.

16 Claims, 10 Drawing Sheets

WELL CONTROL AND RETRIEVAL TOOL

TECHNICAL FIELD

The invention relates generally to a tool for use in production of in-situ fluid from a hydrocarbon producing formation and, more particularly, to a system and associated method for controlling the flow of in-situ fluid in a production well, including the setting and extraction of an electrical submersible pump ("ESP") run on a line.

BACKGROUND OF THE INVENTION

The present invention relates to an apparatus installed downhole in a well bore for improving well control while servicing or replacing submersible pumps or other well flow control equipment. The use of submersible pumps and other equipment designed to improve well flow is commonly used to increasing the rate of production of wells that otherwise produce very slowly. However, pumps and other similar equipment suffer from a limited lifespan in relation to other well components, with pumps generally having a life about one-quarter that of other well components.

Such limited life components require frequent repair and/or replacement, and therefore such components must be withdrawn from the well at the end of their useful service life. Such removal requires that a well be opened; without means to close off the well or kill the well, the removal resulting in loss of well fluid into the surrounding environment, which is an undesirable occurrence. To prevent such spillage, various efforts have been made including the installation of valves or ball chokes beneath the pump. These efforts have been plagued by a variety of problems, including suffering from damage upon being pulled and run back into the hole, from low confidence in positioning, or an inability to function due to buildup in the well. A need therefore exists for a more reliable system of well control which is easily operated, resistant to damage, and not subject to time-consuming periods of waiting due to low confidence in downhole position.

SUMMARY OF THE INVENTION

The present invention provides a well control apparatus for circulating various fluids in a downhole environment, such as kill mud and production fluids in an electric submersible pump, more commonly known in the field as an ESP. In a preferred embodiment, the present well control apparatus may comprise a tubular seal stem that can be inserted into a tubular sub-assembly. The combination of the devices allows for the circulation of fluids in a controlled manner, and may be set above a downhole ESP such that the ESP is secured off of the present well control apparatus, typically with the well control apparatus one joint above the ESP along a tubing string. During use, the well control apparatus allows for the pumping of fluids by the downhole ESP through a plurality of ports located on side walls of the tubular sub-assembly. These ports may be sealed by the insertion of the seal stem into the sub-assembly, with the seal stem secured in place by a series of latching fingers located in recesses along the sides of the seal stem. The latching fingers may be disengaged for retrieval of the seal stem, or may be sheared off in the event the latching fingers become stuck for one reason or another.

DETAILED DESCRIPTION

Figure 1:
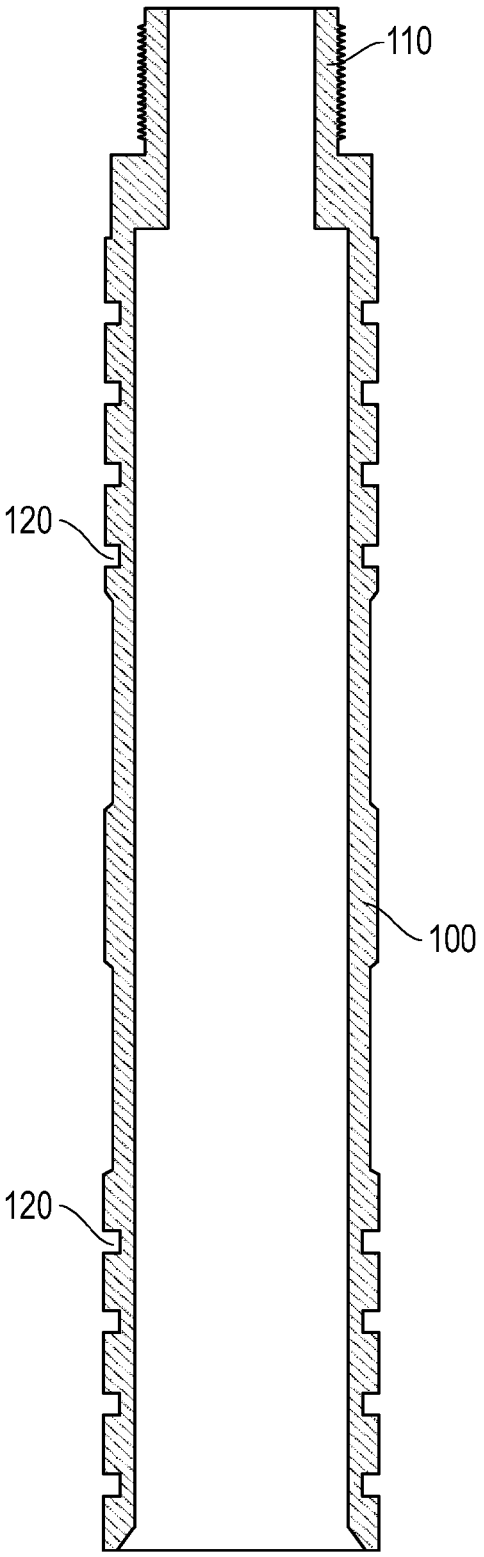
FIG. 1 is a cross-sectional view of a flow nipple illustrated in accordance with a preferred embodiment of the present invention.

Referring to FIGS. 1-18, a downhole well control tool is provided which comprises a number of discrete elements. In FIG. 1, therein is shown a cross-sectional view of a metallic flow nipple 100 which comprises a tubular structure with a plurality of exterior lateral channels 120. The plurality of lateral channels circumscribe the exterior surface of the flow nipple 100, which one of ordinary skill in the art will understand may be used for locating sealing gaskets or o-rings. Alternatively, the lateral channels 120 provide a more rigid and stable gripping surface for retrieval of the flow nipple 100 via a retrieval tool. The flow nipple 100 has a generally hollow interior with substantially smooth internal surfaces which do not impede the flow of fluid within. At a top end of the flow nipple 100, a male threaded connector 110 is provided for threaded connection to other components of the well control tool, namely a tubular lock body 200.

Figure 2:
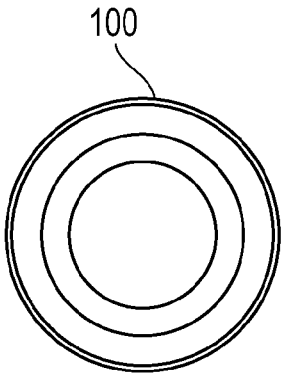
FIG. 2 is a top end view of the flow nipple of FIG. 1.

Referring next to FIG. 2, a top view of the flow nipple 100 is provided and illustrates the generally cylindrical construction of the flow nipple, with the top of the flow nipple 100 having threaded connector 110 having a generally smaller diameter than the bottom of the flow nipple 100.

Figure 3:
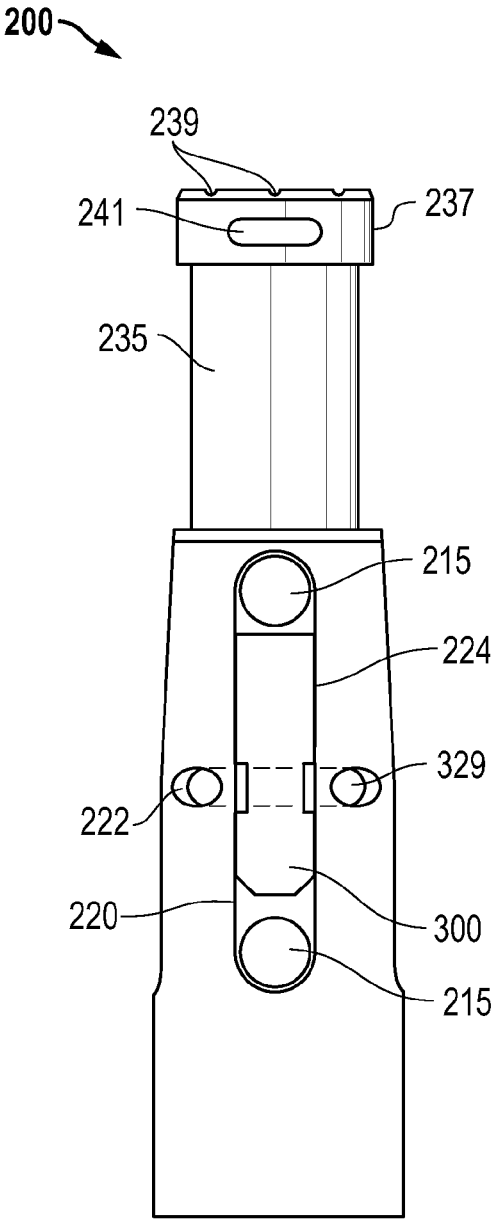
FIG. 3 is a side view of a lock body in accordance with a preferred embodiment of the present invention.

Turning to FIG. 3, a side view of a lock body 200 is shown illustrating how a latching finger 300 is inserted into a latching finger recess 220 disposed within the side of lock body 200. Lock body 200 has a pair of latching fingers 300 disposed into a pair of latching finger recesses 220, with a latching finger 300 placed on either side of lock body 200.

Thus, in FIG. 3, only one of the latching finger recesses 220 is shown, with the other recess 220 on an opposite side of the lock body 200 and obstructed from view. The latching finger recesses 220 each extend along the side of the lock body 200 in a longitudinal direction and further contain through-holes 215 which extend from the exterior of lock body 200 to the interior, such that the exterior and interior are in fluid communication. The addition of through-holes 215 to the sides of the lock body 200 provides additional area for fluid flow through the well control tool, and further enhances the flow through and pump through capability of the tool.

The latching finger recesses 220 each further include a spring wall 224 (not shown), which provides an area for locating an end of a latch spring 327. As shown in FIG. 3, a latching finger 300 has been located within latching finger recess 220, and is pivotally held in place within the latching finger recess 220 by way of a latching pin 329. The latching pin 329 extends first through a pin channel 222 on one side of latching finger recess 220, next through a pin channel 322 that extends through the width of the latching finger 300, and then through a matching pin channel 222 located on an opposite side of latching finger recess 220. The use of the latching pin 329 and pin channels 222 and 322 allows for the securing of the latching finger 300 into the latching finger recess 220 as well as pivotal movement of the latching finger 300 within the latching finger recess 220. Additional details regarding the structure and function of the latching finger 300 will be further discussed below.

The lock body 200 further includes a neck 235 which provides for fluid flow through the lock body 200 and connects the primary portion of the lock body 200 with a flange 237 at the top of lock body 200. The flange 237 is essentially a protruding ridge section of the lock body 200 that allows for improved fishing and retrieval of the tool by providing a greater area for a fishing or overshot tool to latch onto or grab lock body 200. In a preferred embodiment of the present invention, a series of plunges 239 may be located on the top of the flange 237 to facilitate easy identification of the tool type when viewed from above. This makes it relatively easy to determine the qualities and characteristics of the tool without having to fully retrieval and extract the tool from the wellbore. Different versions of the well control tool may have different plunges or other shapes or patterns etched into the top of flange 237 to facilitate quick identification of the tool version or tool type. Flange 237 may further incorporate a pair of pinning mounts 241 (only one shown) located on either sides of the flange 237, in which a running tool pin or other suitable device may be mounted thereto. While optional, the pinning mounts 241 provide additional functionality to the lock body 200 in that a greater variety of tools may be used in conjunction with the well control tool.

Figure 4:
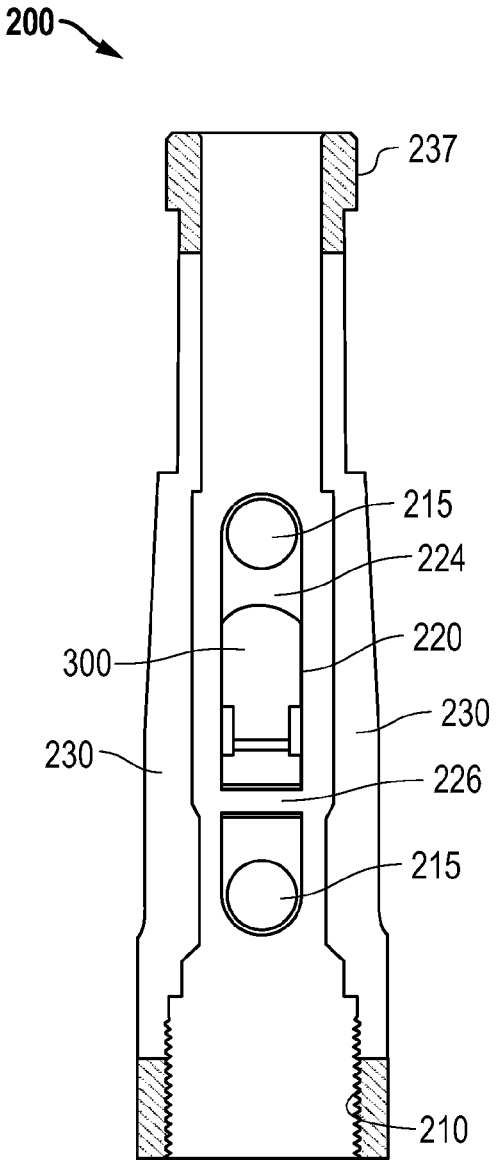
FIG. 4 is a cross-sectional view of the lock body of FIG. 3.

Next, at FIG. 4, therein is shown a cross-sectional view of the lock body 200. In the view of the well control tool shown in FIG. 4, the spring wall 224 may be more clearly seen wherein a spring located in the latching finger 300 may be pressed against the spring wall 224 to provide a tension to a top end of the latching finger 300. Additionally, two flow tracks 230, which are located on opposite sides of the lock body 200 and oriented approximately 90 degrees from the latch finger recess 220 are shown extending a substantial length of the lock body 200. Specifically, in the embodiment shown in FIG. 4, flow tracks 230 extend from an area of the lock body 200 below the latch finger recesses 220 and up into the neck 235. The extended length of the flow tracks 230 provides a substantial area for fluid to flow, and further improves the flow of fluids through the well control tool in relation to other previously available tools. In conjunction with the through-holes 215, maximum flow through and pump through capability for the well control tool may be achieved. At the bottom of the lock body 200, a female threaded connector 210 may be seen. Female threaded connector 210 may be used for threaded connection to the flow nipple 100 by threaded engagement with the male threaded connector 110. By threadedly connecting the flow nipple 100 and lock body 200, a fully assembled seal stem 400 may be formed.

Figure 5:
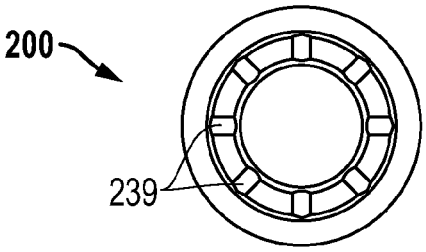
FIG. 5 is a top view of the lock body of FIG. 3.

At FIG. 5, a top view of the lock body 200 is shown, illustrating the relative diameters of the flange 237 as well as the main portion of the lock body 200. Plunges 239 are also shown as they would appear from above, illustrating the ability to quickly identify the tool based on the plunge pattern.

Figure 6:
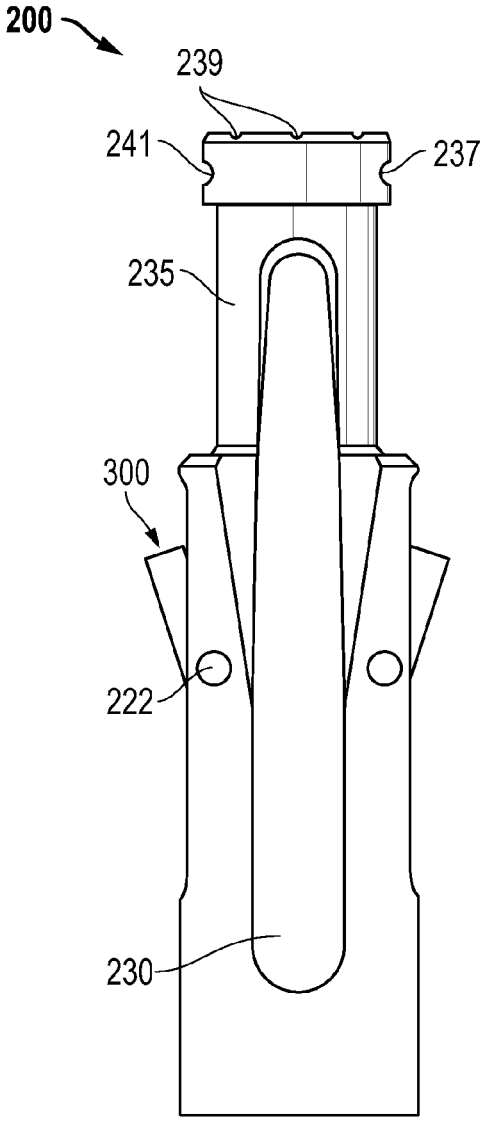
FIG. 6 is a side view of the lock body of FIG. 3 rotated 90 degrees about the longitudinal axis.
Figure 7:
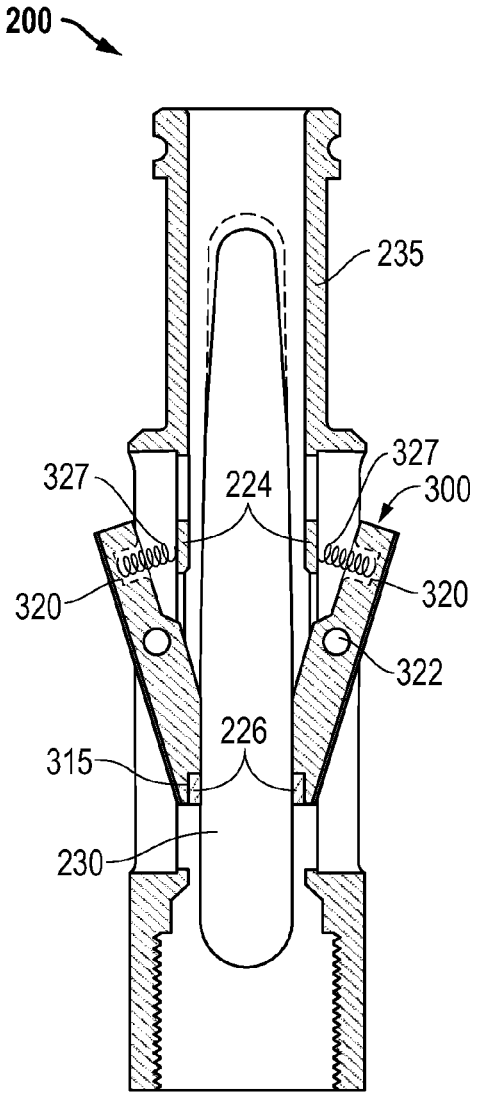
FIG. 7 is a cross-sectional view of the lock body illustrated in FIG. 6.

Referring now to FIGS. 6 and 7, the lock body 200 of FIGS. 3 and 4 has been rotated ninety degrees about its longitudinal axis. As previously described, lock body 200 comprises a pair of flow tracks 230 oriented longitudinally along the side of the lock body 200 between the latching fingers recesses 220, with a flow track 230 located on opposite sides of the lock body 200. Flow tracks 230 extend from an area near the bottom of the lock body 200 and extend up through the neck 235 of the lock body 200, with the flow tracks 230, extending through the tubular body from its exterior surface to its interior surface, thereby providing for fluid communication between the exterior and interior of the lock body 200. Flow tracks 230 are oriented parallel to the longitudinal axis of the lock body 200 and are located ninety degrees around the circular exterior of the lock body 200 from the latching finger recesses 220. The extended length of flow track 230 significantly increases the open area for fluid communication, thereby allowing greater unobstructed flow of fluids between the interior and exterior of lock body 200. This results in more consistent, unimpeded flow of downhole fluids through the lock body 200. As an added benefit of this elongated area, debris that may be immersed in the fluid mixture flow will be less likely to become trapped along flow track 230, thereby decreasing the chance for obstructions to develop along the track. In conjunction with a preferred embodiment of neck 235, these features may further improve flow characteristics in the well control tool not available with other tools known in the industry.

In a preferred embodiment, lock body 200 may further comprise a neck 235 with improved flow characteristics over other similar tools in the industry through the extension of the flow tracks 230 into the neck 235. Such improved flow characteristics are achieved through shortening the length of the lock body neck 235, which reduces the relative distance of the lock body 200 that fluids must pass through during production. As a result of lessening the distance traversed through the lock body 200, there is less back pressure on a downhole ESP, which mitigates fluid choke effects, and consequently allows for greater fluid flow through the lock body 200. In the embodiment of the well control tool shown in FIG. 6, the neck 235 is approximately 1.5" in length.

Remaining on FIG. 6, a side view of pin channels 222 with a top portion of inserted latching fingers 300 may be seen. In the relaxed state of the lock body 200, the top end of latching fingers 300 will naturally protrude from the surface of lock body 200 due to the tension provided by latch springs 327 positioned in a spring recess 320.

Next, FIG. 7 provides a cross-sectional view of the lock body 200 of FIG. 6. In FIG. 7, the latch springs 327 are seen located within the spring recess 320 of latching finger 300. The latch springs 327 have an end pressing against the spring recess 320, and a second end pressing against the spring wall 324. In this manner, the top end of latching fingers 300 will protrude from the surface of lock body 200 when the lock body is not engaged with any other parts or components. The bottom of the latching fingers 300 have a detent 315 which engages a detent wall 226 located on the lock body 200 and stops the bottom of the latching finger from further rotation into the lock body 200.

Figure 8:
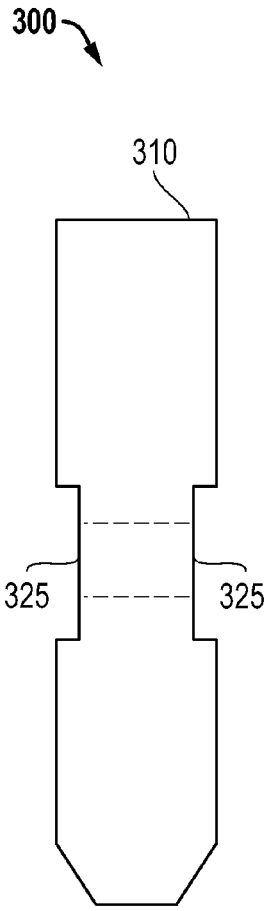
FIG. 8 is a top view of a latching finger of the present invention.
Figure 9:
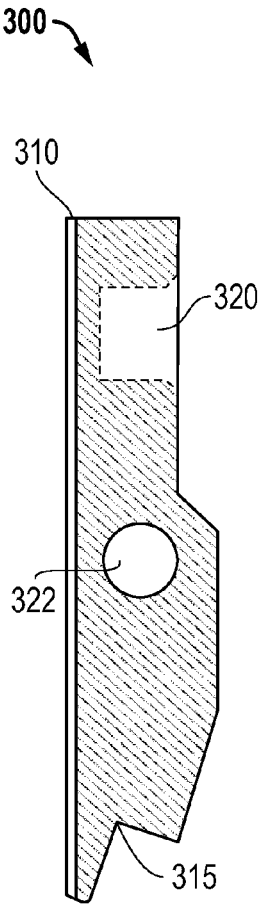
FIG. 9 is a cross-sectional side view of the latching finger of FIG. 8.
Figure 10:
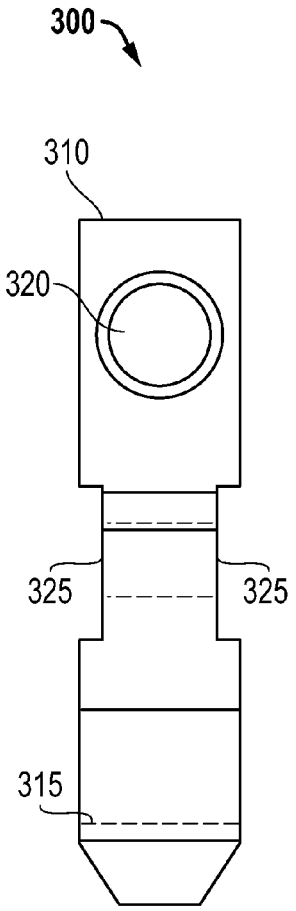
FIG. 10 is a bottom view of the latching finger of FIG. 8.

Referring now to FIGS. 8, 9 and 10, top, side and bottom views of the latching finger 300 are shown. As can be collectively seen in FIGS. 8-10, the latching finger 300 includes a spring recess 320, a pin channel 322 and a latching finger shoulder 310. As described in FIGS. 3-4, a latching finger 300 is placed in each latching finger recess 220 and secured into the recess 220 by means of a latch pin 329 which passes through the pin channels 222 of the lock body 200 and the pin channel 322 of the latching finger 300. Also, as previously described, a latch spring 327 may be placed between the spring wall 224 of the lock body 200 and the latching finger spring recess 320. Under this engagement, the latch spring 327 exerts an outward bias on the end of the latching finger 300 opposite the spring. By means of this arrangement, the latching finger 300 is allowed to rotate about the latch pin 329, which forces the latching finger shoulder 310 outwards from the lock body 200 while forcing the opposite end of latching finger 300 inwards from the exterior of the lock body 200. The opposite end of latching finger 300 further comprises a latching finger detent which engages a detent wall 226 located within latching finger recess 220 of the lock body 200. In this manner, the latching finger 300 may only rotate a certain amount from the outward bias of latch spring 327, thus controlling the distance which the shoulder 310 protrudes from the side of the lock body 200.

In a preferred embodiment of the present invention, latching finger 300 may further comprise a set of notches 325 on either side of the latching finger 300, and adjacent the pin channel 322. Notches 325 are shaped to reduce the opportunity for latching finger 300 to become jammed while rotating about the pin. Further, notches 325 may also assist in the shearability of the pin of latching finger 300 should lock body 200 and consequently tubular seal stem 400 become stuck downhole.

Figure 11:
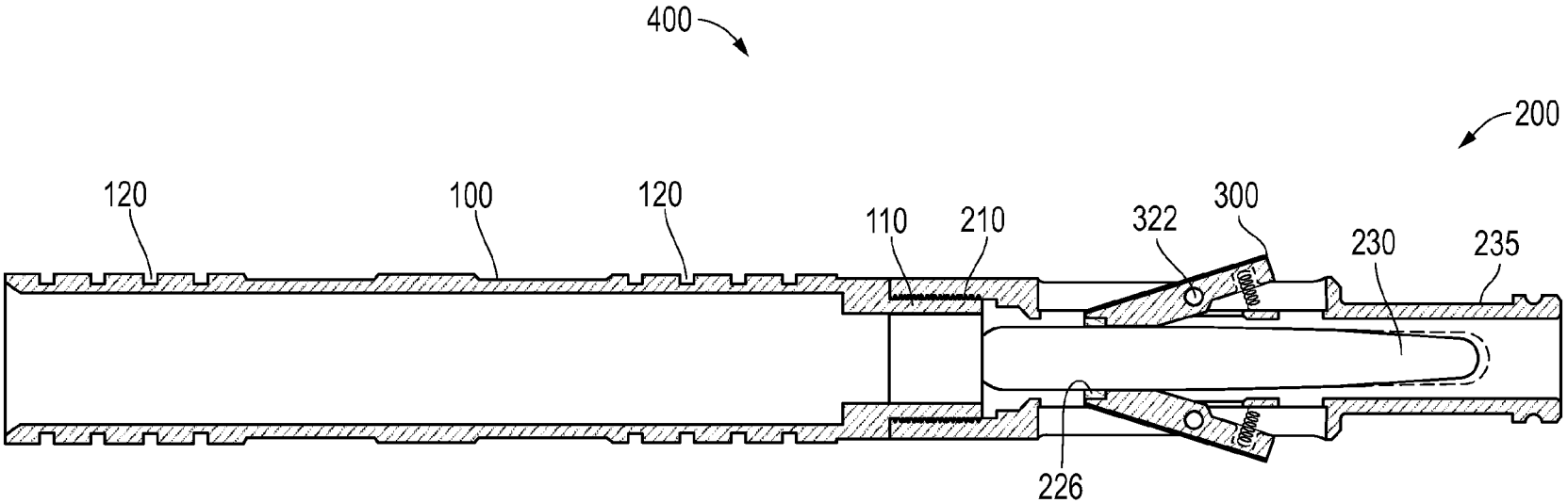
FIG. 11 is a cross-sectional side view of a fully assembled seal stem of the present invention.

Turning now to FIG. 11, a cross-sectional view of a fully assembled tubular seal stem 400 is shown. Tubular seal stem 400 comprises the flow nipple 100 and the lock body 200 threadedly connected together via the respective male threaded connector 110 and female threaded connector 210. As previously mentioned, sealing gaskets and/or o-rings may be placed in the grooves 120 of flow nipple 100 in order to facilitate a fluid tight seal when the tubular seal stem 400 is placed in a tubular sub-assembly 500. The complete tubular seal stem 400 is then ready for use within the tubular sub-assembly 500 in order to control the flow of fluids through the tubular sub-assembly 500.

Figure 12:
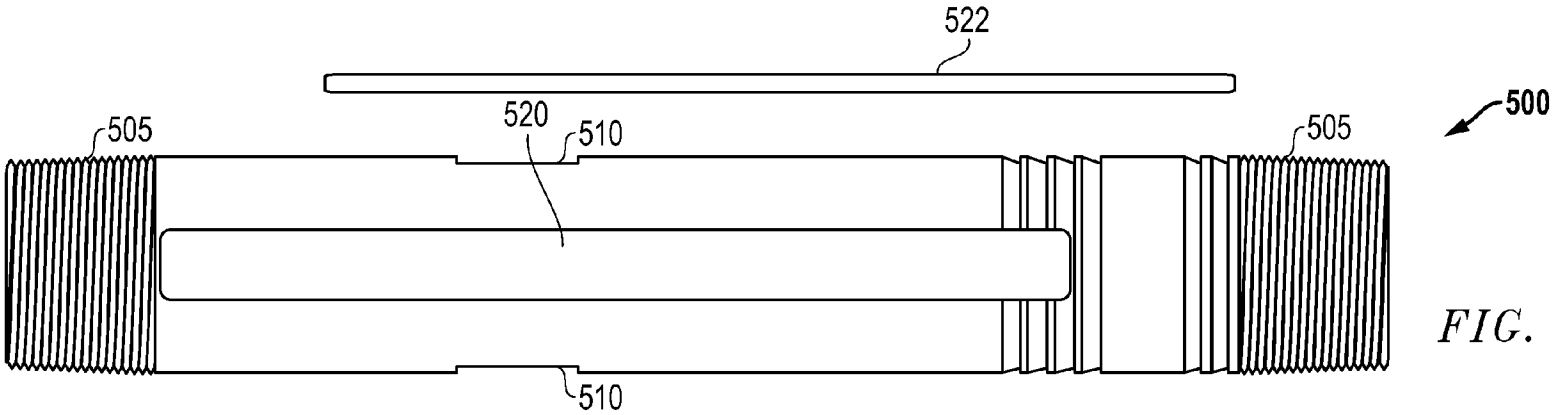
FIG. 12 is a side view of a tubular sub-assembly of the present invention.

Next, FIG. 12 shows a side view of a tubular sub-assembly 500 of a preferred embodiment of the present invention within which the tubular seal stem 400 may be placed when the well control tool is in operation. Sub-assembly 500 has a generally tubular structure and has an internal cavity with a length and width sufficient for engaging and securing seal stem 400. The ends of tubular sub-assembly 500 each have a threaded connector 505 for threaded connection to upstream and downhole portions of a drill string. Along the outer surfaces of the tubular sub-assembly 500 are two longitudinal grooves 520, which are located on opposite sides of the tubular sub-assembly 500 and recessed from the side surface of the tubular sub-assembly 500 and provide an area for locating a cable 522 for the downhole ESP. Cable 522 may be any manner of cable used by a downhole section of the drill string and may comprise electric, hydraulic and other types of lines or cables.

By locating grooves 520 on opposite sides of sub-assembly 500, a well operator may select the appropriate track for optimal routing of cable 522 depending on the location of the cable relative to the position of the groove 522. Further, the benefit of locating cable 522 within groove 520 may help to ensure that cable 522 remains in position along the side of the sub-assembly 500, and does not obstruct ports 510, thereby allowing the well control tool to provide unimpeded flow of fluids downhole. Thus, the grooves 520 provide protection for cable 522 by safely locating the cable 522 away from any potential damage due to particles and debris in the fluid flow.

Figure 13:
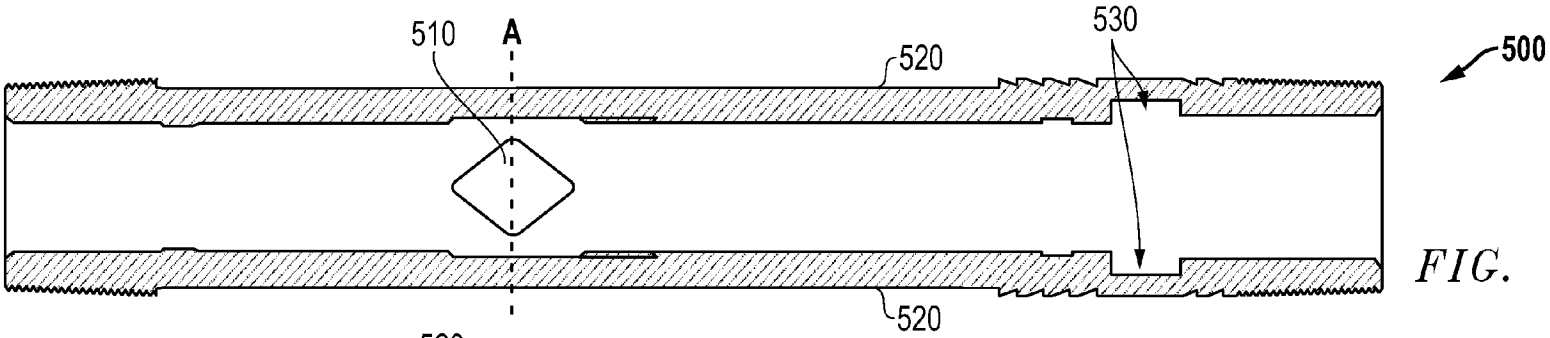
FIG. 13 is a cross-sectional side view of the tubular sub-assembly of FIG. 12 rotated 90 degrees about its longitudinal axis.

Next, at FIG. 13, a cross-sectional view of tubular sub-assembly 500 is shown with the sub-assembly 500 rotated 90 degrees about its longitudinal axis. In the view provided by FIG. 15, a port 510 can be seen located in the side wall of the sub-assembly 500. Port 510 is positioned 90 degrees from the grooves 520 about the longitudinal axis of the sub-assembly 500 and provides fluid communication between the interior and exterior of the sub-assembly 500. An identical port 510 (not shown) is located 180 degrees opposite of the port 510. Thus, the two ports 510 are formed to provide substantially improved flow characteristics of well fluid by allowing for the passage of large pieces of debris typically dispersed within downhole fluids such as kill mud, water, oil or gas.

Figure 14:
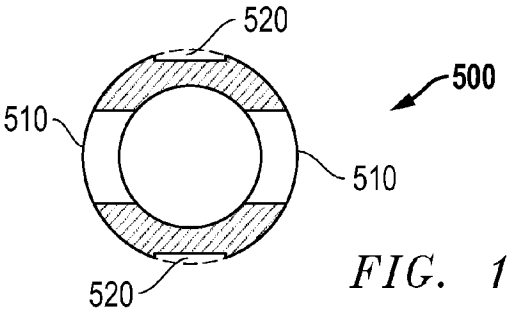
FIG. 14 is a cross-sectional view of the sub-assembly of FIG. 12 as taken along line A.

At FIG. 14, a top cross-sectional view of tubular sub-assembly 500 taken along dotted line A is shown. In this figure, the particular layout of the grooves 520 and ports 510 can be more readily seen. In particular, it can be seen that the ports 510 are oriented opposite one another, and the grooves 520 are oriented opposite one another, with each port 510 located approximately 90 degrees along the longitudinal axis of the sub-assembly 500 from an adjacent groove 520. The particular design of sub-assembly 500 allows for maximum fluid flow through the use of two oppositely aligned ports 510 while also minimizing the opportunity for a cable 522 to obstruct the ports 510 by locating the cable 522 within the grooves 520 as far away from the ports 510 as possible.

In a preferred embodiment of the present invention, ports 510 may be substantially diamond in shape and enlarged to a size that maximizes fluid flow while simultaneously minimizing the opportunity for debris to obstruct the ports. Ports 510 may also be shaped and sized such that the structural integrity of lock flow sub-assembly 500 is not compromised by an overly enlarged port. During the fluid production process, many different types of debris may develop and comingle with fluids to be produced. This debris may include undesirable hydrocarbons such as paraffin, or other compounds such as iron sulfide. As the production fluid is pumped up through the tubular sub-assembly 500 by the ESP, the unwanted paraffin and iron sulfide may begin to build up along the flow track of the sub-assembly 500. If the slots 510 on sub-assembly 500 are improperly shaped or sized, there is a chance that the debris will block the slot, thereby causing a halt in fluid production as well as potentially dangerous back pressure further downhole. Additionally, incorrect shaping and sizing of ports 510 may place significant strain on the structural integrity of tubular sub-assembly 500, thereby leading to premature failure of the sub-assembly 500.

However, due to the shape and size of this preferred embodiment for the ports 510, substantially improved fluid flow characteristics may be achieved. As a result of these substantially improved flow characteristics, there is less back pressure on the ESP, and less downtime attributable to having to retrieve and service the tool as a result of blockage. The reduced back pressure also significantly reduces the opportunity for failures to develop in other equipment further downhole, as well as prolonging the useful service life of the well control tool and downhole ESP.

Figure 15:
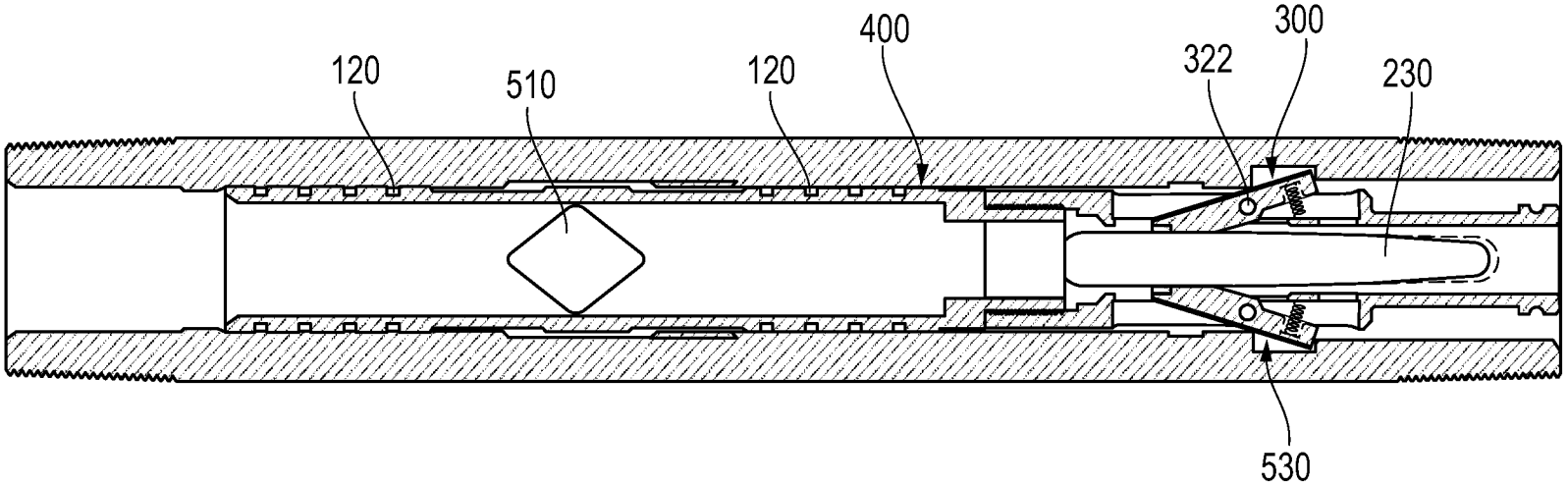
FIG. 15 is a cross-sectional side view of a seal stem inserted into the tubular sub-assembly of FIG. 12.

Referring to FIG. 15, therein is shown a cross-sectional view of the seal stem 400 located within the tubular sub-assembly 500. Through the use of a setting tool, the tubular seal stem 400 may be set into the tubular cavity provided by the tubular-sub assembly 500 by way of the top hole of the tubular sub-assembly 500 in order to seal the flow of fluids through the ports 510 of the tubular sub-assembly 500. Prior to setting the tubular seal stem 400 into the tubular sub-assembly 500, commonly used seals in the field, such as gasket seals or o-rings, may be fitted onto the flow nipple 100 by engaging the gasket seals or o-rings into the circumferential grooves 120 located on the exterior of the flow nipple 100. Upon insertion of the tubular seal stem 400 into the tubular sub-assembly 500, a fluid tight seal may be formed as a result of the gasket seals or o-rings engaging both the exterior wall of the flow nipple 100 and the interior wall of the sub-assembly 500. These seals ensure that no fluid may flow through the ports 510 of the tubular sub-assembly 500. Once the tubular seal stem 400 has been set into the tubular sub-assembly 500, the setting tool may be pulled in an upward motion to ensure that the tubular seal stem 400 is locked in place.

The interior of the tubular sub-assembly 500 has a circumferential recessed area near a top end of the sub-assembly 500 and adjacent the lock body 200, forming lateral circumferential recessed shoulders 530 along the interior of the sub-assembly 500. When the tubular seal stem 400 is placed within the tubular sub-assembly 500 using a downward motion, the latching finger shoulders 310 will be forcibly depressed back into the latching finger recesses 220 of the lock body 200. However, once the shoulders 310 are slidingly engaged with the recessed shoulders 530, the latching finger shoulders 310 spring back out and lock with the recessed shoulders 530, thereby preventing upward movement and withdrawal of the seal stem 400, thus locking the seal stem 400 in place. Additionally, the seal stem 400 is prevented from further downward movement in this position as a result of the engagement of the bottom end of the seal stem 400 with the interior wall of the sub-assembly 500.

Accordingly, while seal stem 400 is engaged within tubular sub-assembly 500, fluids may only flow through the top or bottom apertures of the sub-assembly 500, as the ports 510 are effectively shut off from fluid flow. In this manner, the well control tool controls the flow of downhole fluids such that an operator at the surface may determine whether the flow of fluid through the ports 510 is desired in a given scenario.

Figure 16:
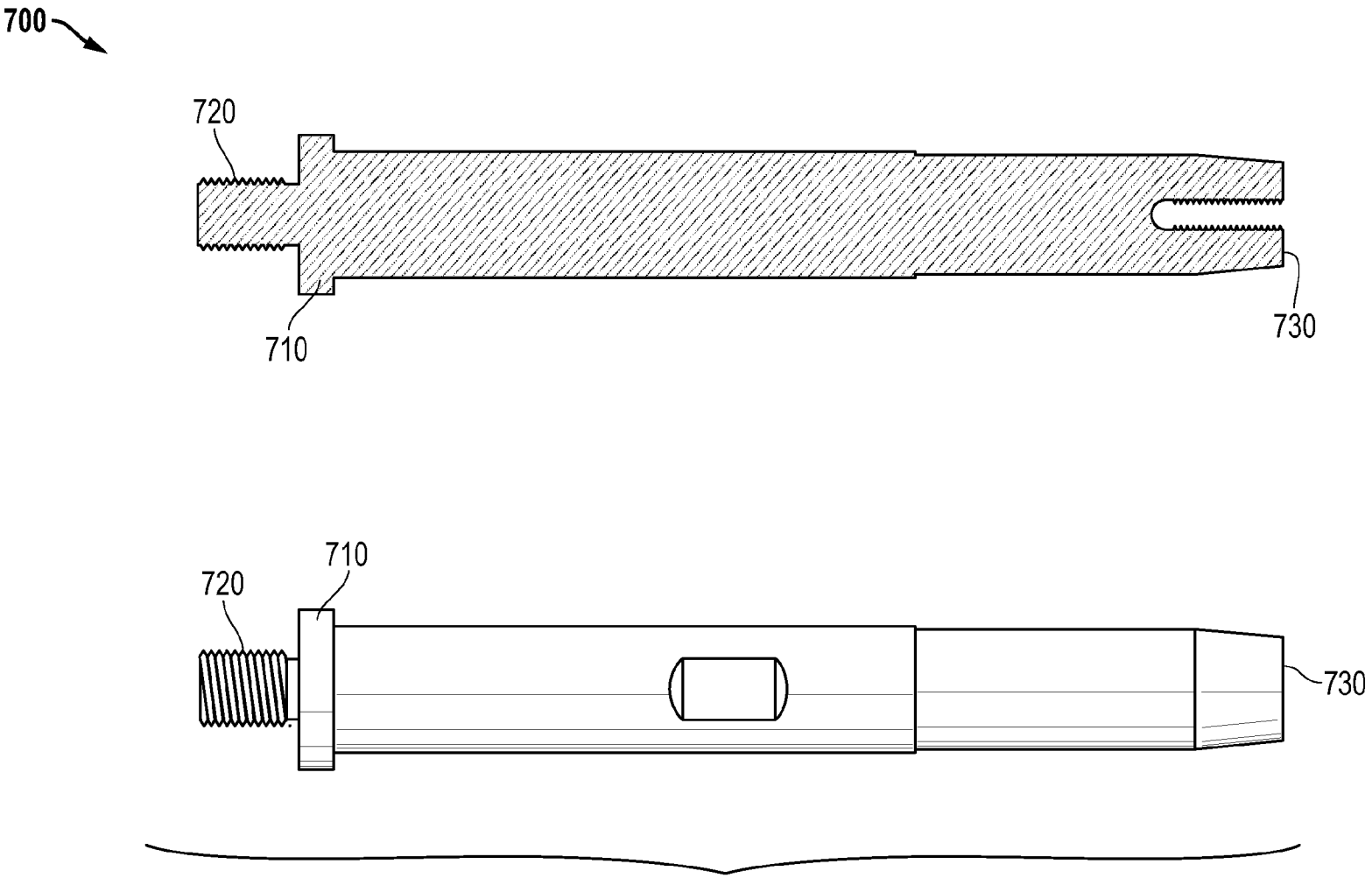
FIG. 16 depicts a side view and a cross-sectional side view of a releasing probe for the present invention.

Next, in FIG. 16, side and cross-sectional views of a releasing probe 700 are provided which is essentially a solid cylindrical shape and includes a shoulder 710. Using a standard overshot tool (not shown), a threaded end 720 of the releasing probe 700 may be attached to the overshot tool in order to engage and release the tubular seal stem 400 from the tubular sub-assembly 500, or more specifically, to disengage the latching fingers 300 located on the lock body 200 from the recessed shoulders 530 of the sub-assembly 500. By inserting a downhole end 730 of the releasing probe 700 through the interior of the tubular seal stem 400, the probe 700 will engage and actuate the latching fingers 300, rotating them until the shoulder 710 passes the latching fingers shoulder 310, at which point the springs cause the latching fingers 300 to rotate back into their unbiased position. In this orientation, the latching fingers shoulders 310 prevent the releasing probe 700 from being withdrawn from the tubular seal stem unless the seal stem is manipulated as described above to allow the tubular seal stem 400 to be disengaged from the tubular sub-assembly 500. Once the latching fingers 300 have been disengaged, an upward motion on the releasing probe 700 releases the tubular seal stem 400 to be retrieved at the surface. If for some reason the latching fingers 300 become stuck such that the releasing probe 700 is unable to actuate the latching fingers 300, the pins 222 may be designed to be shearable so that a mechanical jar will shear pins 222 and disengage latching fingers 300, thereby releasing the tubular seal stem 400.

Figure 17:
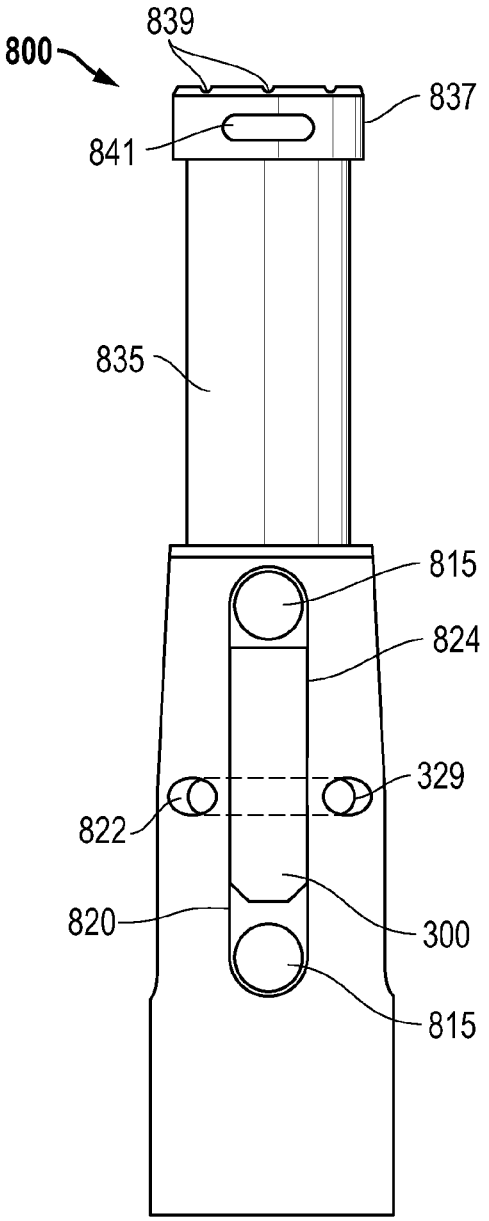
FIG. 17 is a side view of a lock body in accordance with another preferred embodiment of the present invention.

Turning next to FIG. 17, a side view of another preferred embodiment of a lock body 800 is shown. Lock body 800 is a replacement of the lock body 200 and may be threadedly engaged to flow the nipple 100 in similar fashion to the lock body 200. Lock body 800 has corollary parts and functionality with the lock body 200. For instance, lock body 800 has through-holes 815, latching finger recesses 820, pin channels 822, spring walls 824, detent walls 826, flange 837, plunges 839, and pinning mounts 841 which are substantially similar to the corresponding parts in lock body 200. However, in lock body 800, the neck 835 has been lengthened to approximately 2.0" as compared to the approximately 1.5" length of the neck 235 for lock body 200. The advantage of the lengthened neck 835 as compared to the neck 235 is to provide a greater extension of the lock body 800 in order for easier latching and retrieval of the lock body 800. In particular, for situations where there may be a buildup of downhole debris around the lock body 800, such as buildup of iron sulfide or paraffin mixtures, the additional extension provided by the elongated neck 835 may allow for the top flange 837 of the lock body 800 to protrude sufficiently for retrieval of the tool. Additionally, the latching finger 300 shown in this embodiment removes the use of notches 325.

Figure 18:
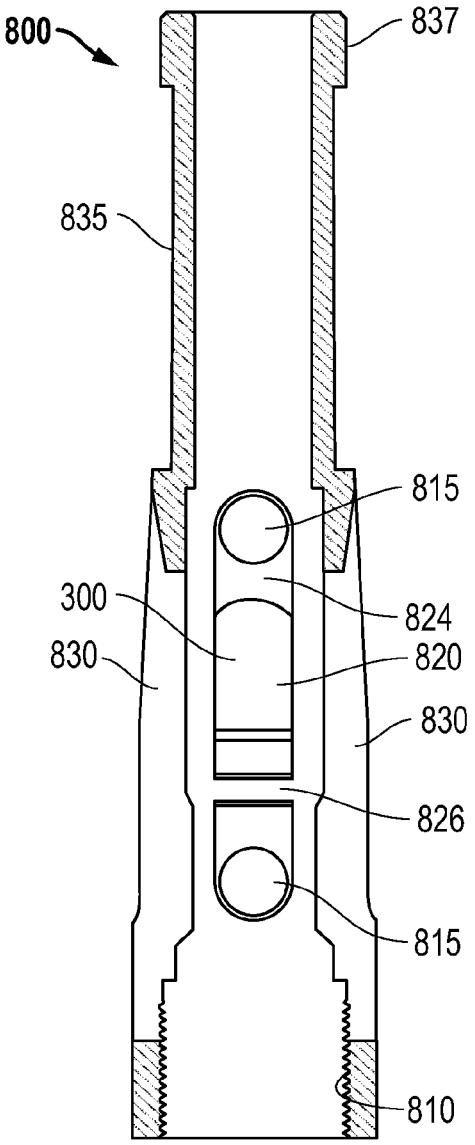
FIG. 18 is a cross-sectional view of the lock body of FIG. 17.

At FIG. 18, a cross-sectional view of the lock body 800 of FIG. 17 is shown. Here, another difference between the lock body 200 and lock body 800 can be seen in that the flow tracks 830 no longer extend into the neck 835 as with flow tracks 230 of lock body 200. Rather, flow tracks 830 terminate at a lateral distance adjacent the spring wall 824. Thus, flow tracks 830 are shorter and provide less flow area relative to flow tracks 230 of the lock body 200. However, as a tradeoff for the lesser flow rate provided by lock body 800, the neck 835 provides increased structural integrity and durability of the lock body 800 as compared to lock body 200. Thus, for certain applications where the priority is placed in maximizing fluid flow, the lock body 200 may be used to provide the greatest amount of flow area. In instances where the downhole fluids may cause problems as a result of buildup of debris, such as iron sulfide or paraffin, the lock body 800 may alternatively be used to provide greater structural integrity of the lock body as well as ease of tool retrieval.

Figure 19:
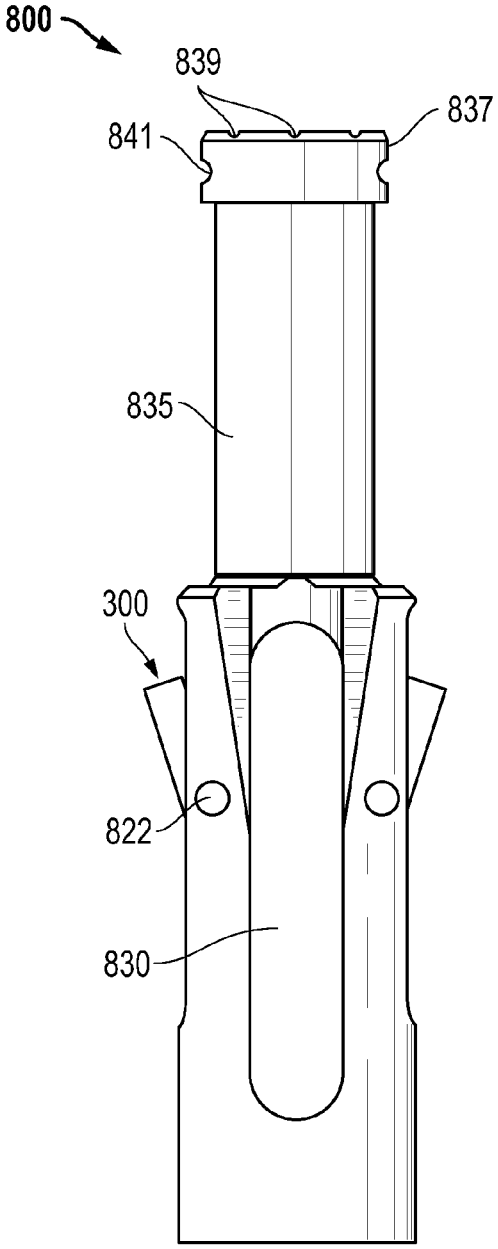
FIG. 19 is a side view of the lock body of FIG. 17 rotated 90 degrees about the longitudinal axis.
Figure 20:
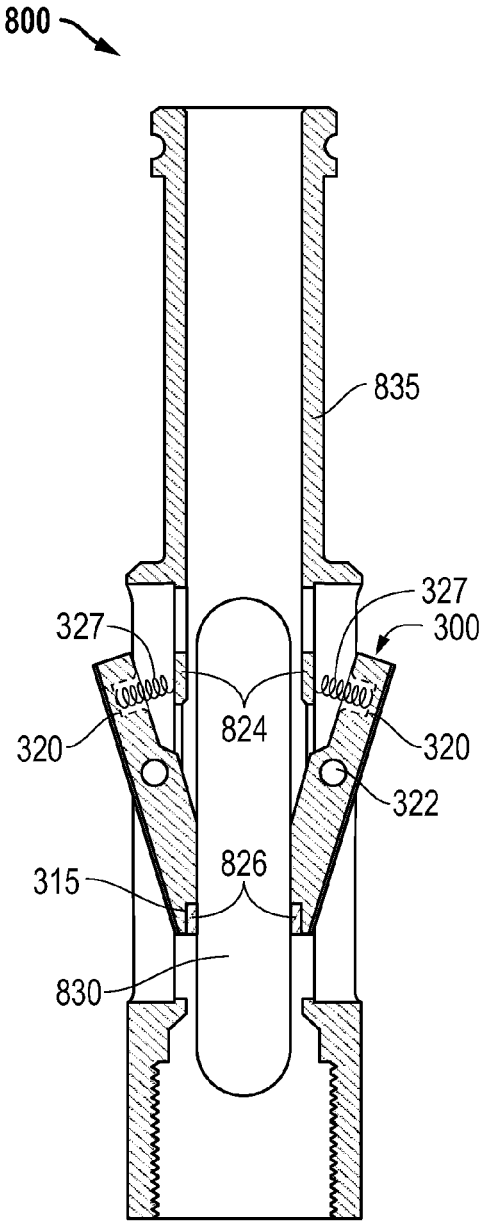
FIG. 20 is a cross-sectional view of the lock body illustrated in FIG. 19.

Next, at FIGS. 19-20, side and cross-sectional views of the lock body 800 are shown rotated approximately 90 degrees about its longitudinal axis from the view of lock body 800 shown in FIGS. 17-18. Here, it can be more clearly seen that flow tracks 830 have been shortened relative to the flow tracks 230 of lock body 830. In particular, the top end of flow track 830 now terminates roughly adjacent the top of latching finger 300, and no longer extends into the neck 835. All other elements of lock body 800 remain essentially the same as with lock body 200, including the spring wall 824 and detent wall 826, for example.

In a preferred embodiment of the present invention, the flow nipple 100, lock body 200 and tubular sub-assembly 500 may be fabricated from stainless steel or other suitably durable and wear-resistant materials. Other materials may also be used to fabricate the components of the well control tool so long as they have sufficient wear, corrosion and hardness to withstand the intense pressures and temperatures as is typical in a downhole environment. Further, the latching fingers 300 and latch pin 329 may also be fabricated from various suitable metals, with the latch pin 329 ideally manufactured to be shearable in the event the lock body 200 becomes stuck within the sub-assembly 500.

It will be understood that while specific embodiments of the instant invention have been described, other variants are possible and are encompassed within this description, which will be readily apparent to those of ordinary skill in the art and will be readily understood to be encompassed by the instant invention. Those of ordinary skill in the art will understand the methods of fabricating the instant invention and will readily comprehend its manner of use and intended use.

The invention claimed is:

1. A well control tool comprising:

a tubular sub-assembly having an interior cavity, the sub-assembly having a port in fluid communication between the interior and exterior of the sub-assembly;

a tubular seal stem insertable into the interior cavity of the tubular sub-assembly, the seal stem comprising:

a lock body having a longitudinal flow track formed in the wall of the lock body and a rotatable latching finger located in a longitudinal recess in the wall of the lock body; and, a flow nipple connected to the lock body, the flow nipple for sealing the fluid port when the seal stem is inserted into the sub-assembly; and, a releasing probe for the release and retrieval of the tubular seal stem from the interior cavity of the sub-assembly.

2. The well control tool of claim 1, the flow track having an end extending into a neck of the lock body.

3. The well control tool of claim 1, the flow track having an end terminating below a neck of the lock body.

4. The well control tool of claim 1, the latching finger pivotally connected to the lock body via a latch pin.

5. The well control tool of claim 1, the latch pin made of a shearable material.

6. The well control tool of claim 1, the latching finger having an end biased outwards from the lock body via a spring located in a recess of the latching finger.

7. The well control tool of claim 1, the flow nipple having one or more lateral circumferential grooves located along the exterior thereof.

8. The well control tool of claim 7, the flow nipple comprising one or more circular seals located in the lateral circumferential grooves.

9. The well control tool of claim 1, the port having a substantially diamond shape.

10. The well control tool of claim 1, the tubular sub-assembly further comprising at least one longitudinal groove on an exterior surface thereof.

11. The well control tool of claim 10, the longitudinal groove for locating a cable.

12. The well control tool of claim 1, the tubular sub-assembly further comprising one or more lateral circumferential grooves located along the exterior of the sub-assembly.

13. The well control tool of claim 1, the tubular sub-assembly further comprising a threaded connector on a first end of the tubular sub-assembly.

14. The well control tool of claim 1 wherein the tubular sub-assembly further comprises an interior circumferential shoulder for engagement to the rotatable latching finger.

15. A lock body for use in a well control tool, comprising:

a tubular body having a hollow interior configured for fluid flow;

a tubular neck connected to a top end of the tubular body;

a pair of flow tracks disposed along opposite sides of the tubular body, the pair of flow tracks extending longitudinally along the outer surface of the tubular body and extending through the tubular body from its exterior surface to its interior surface, thereby providing for fluid communication between the hollow interior and an exterior of the tubular body;

a pair of latching fingers recesses disposed along opposite sides of the tubular body and adjacent the pair of flow tracks; and each of the latching fingers being rotatably connected to the lock body via a shearable latching pin.

16. A lock body for use in a well control tool, comprising:

a tubular body having a hollow interior configured for fluid flow;

a tubular neck connected to a top end of the tubular body;

a pair of flow tracks disposed along opposite sides of the tubular body, the pair of flow tracks extending longitudinally along the outer surface of the tubular body and extending through the tubular body from its exterior surface to its interior surface, thereby providing for fluid communication between the hollow interior and an exterior of the tubular body;

a pair of latching fingers recesses disposed along opposite sides of the tubular body and adjacent the pair of flow tracks; and the latching fingers being biased against the tubular body through use of a latch spring.

* * * * *